US005136834A

United States Patent [19]

Städele

[11] Patent Number: 5,136,834

[45] Date of Patent: Aug. 11, 1992

[54] APPARATUS FOR TRANSPORTING BOBBIN TUBES OF A TEXTILE MACHINE

[75] Inventor: Norbert Städele, Göppingen, Fed. Rep. of Germany

[73] Assignee: Zinser Textilmaschinen GmbH, Ebersbach/Fils, Fed. Rep. of Germany

[21] Appl. No.: 536,164

[22] Filed: Jun. 11, 1990

[30] Foreign Application Priority Data

Jun. 9, 1989 [DE] Fed. Rep. of Germany ..... 3918877

[51] Int. Cl.[5] ..... D01H 9/18; B65H 67/06

[52] U.S. Cl. ..... 57/281; 198/803.01

[58] Field of Search ..... 57/281, 90, 276, 274, 57/267, 270, 266; 242/35.5 A; 198/744, 803.01, 465.1, 465.2

[56] References Cited

U.S. PATENT DOCUMENTS

| | | | |
|---|---|---|---|
| 3,382,659 | 5/1968 | Schulz et al. | 57/281 |
| 3,905,184 | 9/1975 | Takai et al. | 57/261 X |
| 4,432,198 | 2/1984 | D'Angolo | 57/266 X |
| 4,667,807 | 5/1987 | Sanno | 242/35.5 X |
| 4,747,482 | 5/1988 | Sanno | 198/803.1 |
| 4,813,222 | 3/1989 | Fukuda et al. | 57/274 |
| 4,845,937 | 7/1989 | Kiriake et al. | 57/281 |
| 4,875,572 | 8/1989 | Kiriake | 198/744 |
| 4,964,269 | 10/1990 | Dinkelmann | 57/90 X |

FOREIGN PATENT DOCUMENTS

| | | | |
|---|---|---|---|
| 0355887 | 2/1990 | European Pat. Off. . | |
| 9192733 | 11/1984 | Japan | |
| 3012727 | 1/1988 | Japan . | |
| 3050536 | 3/1988 | Japan . | |
| 1081770 | 3/1989 | Japan | 57/281 |
| 9003461 | 9/1988 | Switzerland | 57/270 |

*Primary Examiner*—Daniel P. Stodola
*Assistant Examiner*—John F. Rollins
*Attorney, Agent, or Firm*—Shefte, Pinckney & Sawyer

[57] ABSTRACT

A transport apparatus is provided for transporting tubes of the type onto which yarn is built at a spinning machine to form full yarn packages. The transport apparatus includes a flexible endless member arranged for travel in a path along the spindle bank and carrier members mounted to the flexible endless member for releasably retaining a plurality of independent tube support members, each of which has a vertical post for receiving a tube inserted thereon for individual support of the tube in an upright disposition. The transport apparatus also includes a plurality of spaced fixed tube support members secured to the flexible endless member, each having a vertical post for receiving a tube inserted thereon. The vertical posts of the independent tube support members and the fixed tube support members are spaced apart at a spacing substantially equal to the uniform spacing between the spindles of the spinning machine. The carrier members each include a lower, upper and intermediate portion formed in a C-shaped configuration to form an opening for receiving the bases of independent tube support members therein. The carrier members retain the independent tube support members in alternating relation with the fixed tube support members along the extent of the flexible endless member.

18 Claims, 10 Drawing Sheets

APPARATUS FOR TRANSPORTING BOBBIN TUBES OF A TEXTILE MACHINE

BACKGROUND OF THE INVENTION

The present invention relates to an apparatus for transporting bobbin tubes of a textile machine.

In German Offenlegungsschrift DE 37 12 027, a transport apparatus is disclosed for transporting both tubes having yarn built thereon and empty tubes to and from a textile machine. Each tube is supported by a peg tray-type tube support device having a peg for insertion of the tube thereon to support the tube in an upright disposition. The peg trays are guided in a generally U-shaped guide conduit during their travel. The transport apparatus is operable, for example, to deliver empty tubes to the spinning stations of a conventional textile spinning machine and to transport away tubes having full yarn packages built thereon from the spinning stations.

In a tube exchange process, each peg tray supports an empty tube, and the peg trays are guided to predetermined tube exchange positions adjacent the spinning stations in position for engagement by a conventional tube transfer apparatus. The conventional tube transfer apparatus transfers the tubes having full yarn packages built thereon from the spinning stations onto a row of temporary storage posts disposed between the spindle bank and the guide conduit in which the peg trays are guided to positions adjacent the spinning stations. The tube transfer apparatus then transfers the empty tubes supported on the peg trays to the spinning stations. Thereafter, the tube transfer apparatus transfers the tubes having full yarn packages built thereon from the row of temporary support posts to the peg trays and the transport apparatus is then operated to transport the peg trays to a further handling location. However, the need still exists for a tube transfer apparatus which improves the efficiency and reliability of the tube transfer process and which minimizes the space requirements of the components for temporarily supporting the tubes having full yarn packages built thereon after these tubes have been initially removed from the textile handling stations of a textile machine.

SUMMARY OF THE INVENTION

The present invention incorporates the temporary support of tubes during transfer at spinning stations on the member that transports the tubes to and from the spinning stations, thereby providing improved efficiency and reliability of the tube transfer process and minimized space requirements for the temporary support of tubes.

Briefly described, the present invention provides a transport apparatus for transporting tubes in a textile spinning machine of the type in which yarn is handled on tubes, the spinning machine having a plurality of spindles supported on a spindle bank at a uniform spindle spacing from one another. The transport apparatus includes a plurality of independent tube support members, each having a vertical post for receiving a tube inserted thereon for individual support of the tube in an upright disposition, and a flexible endless member arranged for travel in a path along the spindle bank. Additionally, the transport apparatus includes drive means for driving the flexible endless member in its travel path and retaining means, mounted to the flexible endless member, for releasably retaining the independent tube support members for transport by the flexible endless member.

The retaining means supports the independent tube support members with the vertical posts of the tube support members spaced apart at a spacing substantially equal to the uniform spacing between the spindles of the spinning machine. Finally, the preferred embodiment of the transport apparatus includes a plurality of spaced fixed tube support members secured to the flexible endless member, each fixed tube support element having a vertical post for receiving a tube inserted thereon for transport of the tube by the flexible endless member. The fixed tube support members are spaced apart with the vertical posts of the fixed tube support members spaced apart at a spacing substantially equal to the uniform spacing between the spindles of the spinning machine.

According to one aspect of the present invention, each independent tube support member includes a tube end support collar from which the vertical post of the tube support member projects, the tube end support collar having a surface for supporting the end of a tube inserted on the vertical post. Also, each fixed tube support member includes a tube end support portion from which the vertical post of the fixed tube support member extends, the tube end support portion having a surface for supporting the end of a tube inserted on the vertical post. The retaining means supports the independent tube support members at a height at which the surfaces of the tube end support collars of the independent tube support members are generally at the same height as the surfaces of the tube end support portions of the fixed tube support members.

According to a further aspect of the present invention, each independent tube support member includes an annularly shaped base, and the retaining means includes a plurality of carrier members mounted on the flexible endless member at uniform spacings therealong. In one modification of the apparatus, each adjacent pair of carrier members has a space therebetween less than the diameter of the base of the tube support members and adjacent carrier members cooperate to releasably retain an independent tube support member therebetween for transport by the flexible endless member.

In the preferred embodiment, each carrier member includes a lower portion extending transversely with respect to said flexible endless member and having an upper surface at a vertical spacing above the flexible endless member, an upper portion having a lower surface positioned at a vertical spacing above the upper surface of the lower portion, and an intermediate portion. The upper surface of the lower portion and the lower surface of the upper portion form the opening therebetween for receiving the bases of independent tube support members therebetween and the intermediate portion is positioned for limiting the lateral movement of supported independent tube support members with the upper portion and intermediate portion retaining independent tube support members on the lower portion.

Each upper portion preferably includes an upper surface and the vertical post of each fixed tube support member extends from the upper surface of a respective upper portion. The upper surface of each upper portion supports a tube end of a tube inserted onto the respective vertical post extending therefrom.

Additionally, in the preferred embodiment, the lower portion, the intermediate portion and the upper portion are integrally formed in a C-shaped configuration. The C-shaped configuration includes a foot portion extending from the lower portion and secured to the flexible endless member.

According to a different aspect of the present invention, the retaining means includes a plurality of carrier members mounted on the flexible endless member at uniform spacings therealong, the carrier members are operable to retain the independent tube support members in alternating relation with the fixed tube support members along the extent of the flexible endless member. The carrier members preferably retain the independent tube support members with the vertical posts of the independent tube support members spaced from the vertical posts of the fixed tube support members at a spacing substantially equal to one half the spindle spacing.

DETAILED DESCRIPTION OF THE PREFERRED EMBODIMENTS

Figure 1:
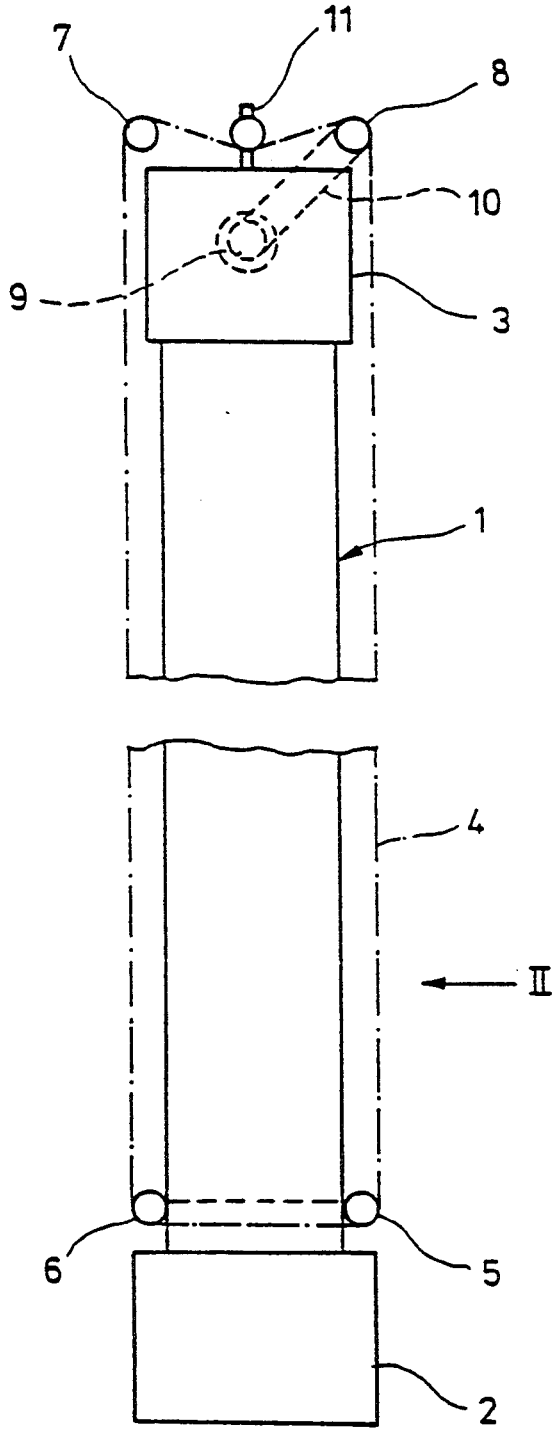
FIG. 1 is a schematic plan view of a textile spinning machine with the preferred embodiment of the transport apparatus of the present invention operatively incorporated therein.

Referring to the drawings, the preferred embodiment of the transport apparatus of the present invention is illustrated in conjunction with a conventional textile spinning machine such as, for example, a ring spinning machine 1, that includes a pair of end frames 2, 3, and a plurality of spinning stations (not shown) disposed between the end frames 2, 3. The spinning stations each operate in conventional manner to wind yarn onto tubes to form yarn packages thereon.

The transport apparatus is provided for delivering empty tubes to the spinning stations and for transporting tubes having yarn built thereon from the spinning stations to a location for further handling. The transport apparatus includes a flexible endless member in the form of a flat metal belt 4 extending around the periphery of the spinning stations in a closed loop. The belt 4 is trained around a plurality of change of direction members 5–8 for guiding the belt 4 along its endless closed loop path. Each change of direction member 5, 6, 7 and 8 which can be, for example, a generally circular cog wheel, is rotatably mounted to the textile machine 1 for rotation about a vertical axis.

Figure 2:
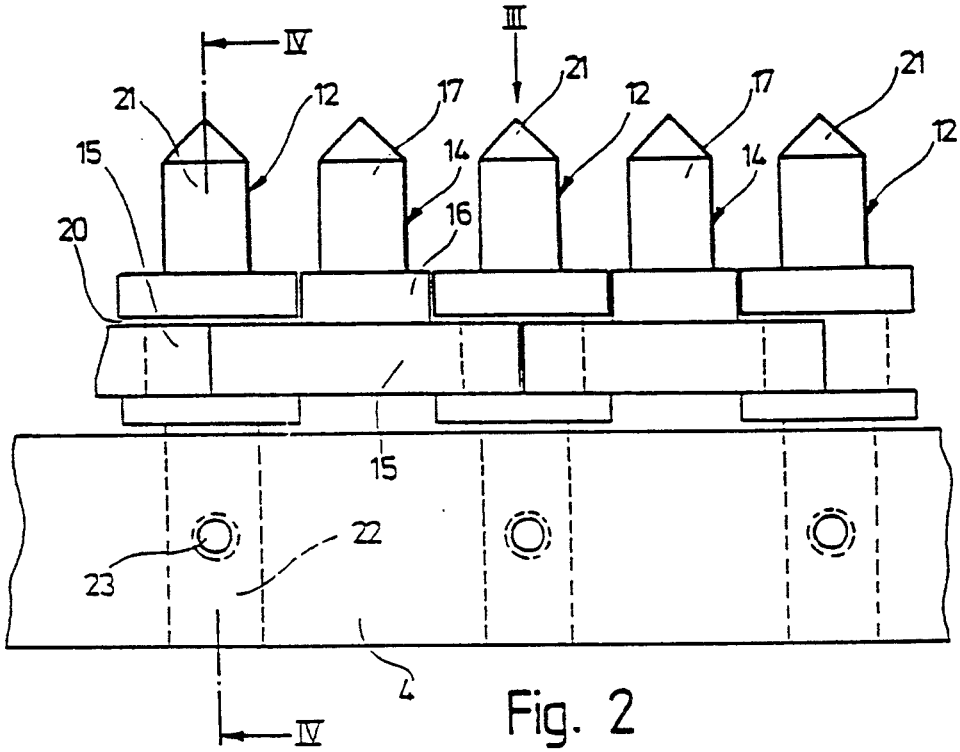
FIG. 2 is an enlarged elevational view of a portion of the transport apparatus shown in FIG. 1 as viewed from the position II in FIG. 1.
Figure 3:
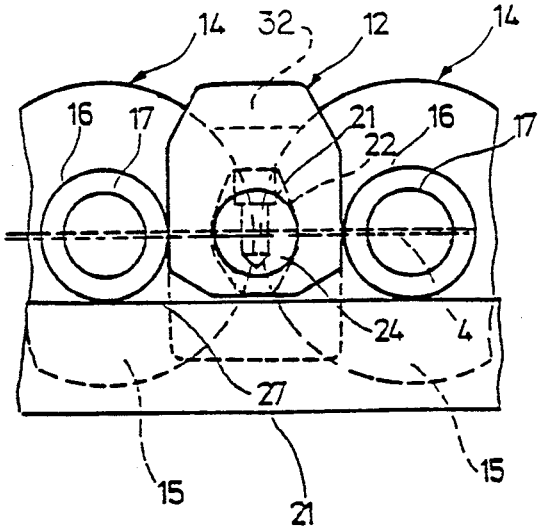
FIG. 3 is a plan view of a portion of the transport apparatus shown in FIG. 2 as viewed from the position III in FIG. 2.
Figure 4:
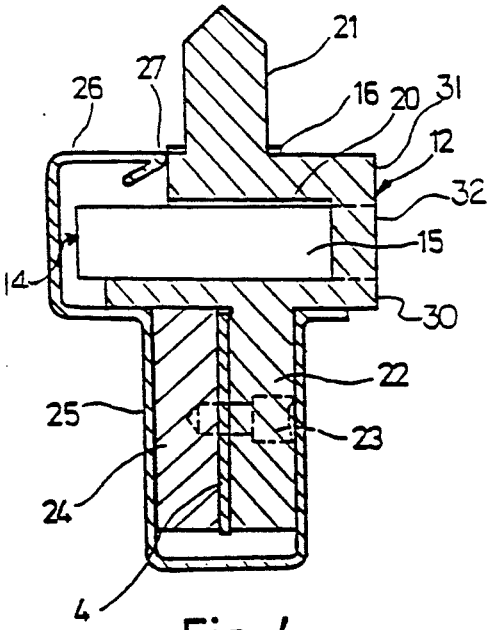
FIG. 4 is a vertical sectional view of the transport apparatus shown in FIG. 2 and taken along line IV—IV thereof.

As best seen in FIGS. 2–4, the belt 4 is flat with its flat sides forming an elongate extent transverse to its endless extent and it is supported during its travel in its endless travel path with its elongate extent or flat sides at a generally vertical orientation. To support the belt 4 in an orientation in which its elongate extent is generally vertical, the transport apparatus additionally includes a fixed guide means in the form of a channel 25 and a plurality of movable guide members connected to the belt 4 at spaced intervals and movable therewith. The fixed guide channel 25 includes, as best seen in FIG. 4, a lower portion having a generally U-shaped cross section, a pair of horizontal flanges projecting laterally outwardly from the top of the sides of the U-shaped lower portions, and an upper guide shoulder portion 26 projecting upwardly and laterally inwardly from the outer end of the outermost of the horizontal flanges. The upper guide shoulder portion is formed with a rounded inner edge 27 which can be formed, for example, by bending of the material comprising the upper guide shoulder portion.

Each movable guide member includes a pair of laterally projecting portions or blocks 22, 24 with each of the blocks 22, 24 projecting laterally from the belt 4 in opposed disposition. As seen in FIG. 2, the blocks of each respective pair of blocks 22, 24 are interconnected to each other and to the belt 4 by a conventional interconnecting component 23 which can be, for example, a bolt. Each projecting block 22, 24 includes an arcuate surface arranged in facing disposition to the belt 4 to accommodate arcuate flexing of the belt 4 as it changes direction in traveling around its endless path. The belt 4 is preferably formed of flexible steel, such as, for example, band steel, and the projecting portions 22, 24 are preferably formed of plastic material.

The U-shaped portion of the fixed guide channel 25 has a lateral extent compatibly configured with the cross sectional lateral extent of the blocks 22, 24 for receiving the blocks therein in relatively close fitting yet freely movable disposition for guiding of the blocks 22, 24 and connected belt 4 in the endless travel path of the belt.

The transport apparatus additionally includes a plurality of carrier members 12 secured to the belt 4 for retaining a plurality of conventional independent tube support members in the form of peg trays 14 and a plurality of empty tubes during transport thereof by the belt 4. Each carrier member 12 is associated with one of the pairs of guide blocks 22, 24. As best seen in FIGS. 3 and 4, each carrier member 12 is formed in a generally C-shape configuration, having a lower portion 30 that is preferably integrally formed with the inner guiding block 22 and extends laterally over the lateral flanges of the guide channel 25 for support thereby and for support thereon of the peg trays 14. The C-shape of the carrier members 12 is designed to cooperate with the upper guide shoulder portion 26 of the fixed guide means 25 to reliably retain the peg trays 14 in a desired orientation during their transport by the flexible endless member 4. Specifically, each carrier member 12 is compatibly configured with respect to the annular base portion 15 of a peg tray 14, which comprises the largest lateral extent of the peg tray, to overlap the peg tray base portion 15 and to abut the collars 16 of adjacent peg trays 14 which are above and of lesser radius than the base portions 15 thereby spacing the peg trays 14 from one another. The collars 16 of the peg trays 14 have formed thereon upwardly projecting vertical posts or pegs 17 onto which tubes are inserted for support by the peg tray 14.

Each carrier member 12 includes an upper portion 31 projecting horizontally from an intermediate portion 32 that extends upwardly from the lower portion 30 of the carrier member 12. The upper portion 31 and the lower portion 30 define therebetween an opening 20 for receiving the base portions 15 of adjacent peg trays 14. Each upper portion 31 is configured to extend over a portion of the base portions 15 of each of a pair of adjacent peg trays 14, as seen in FIG. 3, and has an extent as measured in the direction of the belt 4 compatibly configured with the diameter of the collar portions 16 of the peg trays 14 such that the carrier members 12 cooperate to retain the collars 16 of adjacent peg trays 14 disposed therebetween in relatively close yet releasable disposition.

The intermediate portion 32 of each carrier member 12 projects upwardly from the transversely innermost extent of the lower portion 30 and abuts the base portions 15 of the pair of adjacent peg trays 14 associated with the respective carrier member 12 to prevent laterally inward displacement of the peg trays while the upper shoulder portion 26 of the guide channel 25 prevents laterally outward displacement of the peg trays.

The base portions 15 of each adjacent pair of peg trays 14 are supported on the lower portion 30 of the associated carrier member 12 with each peg tray 14 being supported on the lower portions 30 of adjacent carrier members 12. As seen in FIG. 4, the lower portion 30 of each carrier member 12 has a lateral extent with respect to the belt 4 sufficient to extend over the horizontal flanges of the fixed guide channel 25. Accordingly, it can be seen that the belt 4 is horizontally and vertically supported on, yet spaced from, the guide means 25 during its travel in an endless travel path around the spinning stations of the textile machine 1. The projecting portions 22, 24 space the belt 4 from the U-shaped lower portion of the guide channel 25 while the base portions 30 of the carrier members 12 slide along the horizontal flanges of the guide channel 25 to support the belt 4 at a uniform vertical disposition during its travel. Additionally, the peg trays 14 are supported in a uniform lateral orientation relative to the belt 4 through the lateral movement limiting characteristics of the intermediate portions 32 of the carrier members 12 and the upper guide shoulder portion 26 of the guide channel 25. Moreover, since each peg tray 14 is supported on the lower portions 30 of adjacent carrier members 12, the peg trays 14 and their tube supporting pegs 17 and tube end supporting collars 16 are maintained at a uniform height during their transport by the belt 4. Since the belt 4 is not in contact with the guide channel 25 during its travel, detrimental frictional wear of the belt 4 is avoided.

Each carrier member 12 also includes, as seen in FIGS. 2 and 3, a post 21 extending vertically from the upper surface of its upper portion 31. Each post 21 is configured with respect to the tubes transported by the belt 4 for snugly receiving a tube inserted thereon to support the tube during travel of the belt 4. In this regard, the upper surface of the upper portion 31 acts as a tube end support portion for supporting the end of a tube inserted on the post 21. The posts 21 of the carrier members 12 are laterally positioned on the upper portions 31 of the carrier members such that the posts 21 are generally laterally centered on the belt 4—i.e., each post 21 is laterally aligned with the peg portions 17 of the peg trays 14 which are supported by the carrier members 12. Additionally, the vertical extents of the posts 21 of the carrier members 12 are such that the uppermost free ends of the posts are generally at the same height as the upper ends of the peg portions 17 of the peg trays 14. Thus, each vertical post 21 and associated upper portion 31 form a fixed tube support member secured to the belt 4 with the fixed tube support members being spaced apart at a spacing substantially equal to the uniform spacing between spindles of the spindle bank.

As seen in FIG. 1, one of the change of direction wheels 8 is driven by a conventional power source which includes a conventional motor 10 and a conventional endless drive member 9 interconnecting the output shaft of the power motor 10 and the change of direction wheel 8 for driving rotation of the wheel, with the cogs of the wheel 8 extending laterally between and driving engaging the inner guide blocks 22 to drive the endless belt 4. Additionally, a belt tensioning assembly 11 is provided for selectively adjusting the tension of the belt 4 during its travel. The tensioning assembly 11 is operable to selectively increase or decrease the effective length of the extent of the endless member between the adjacent change of direction wheels 7 and 8 to thereby effect corresponding increases or decreases in the tension of the belt 4.

Figure 5A:
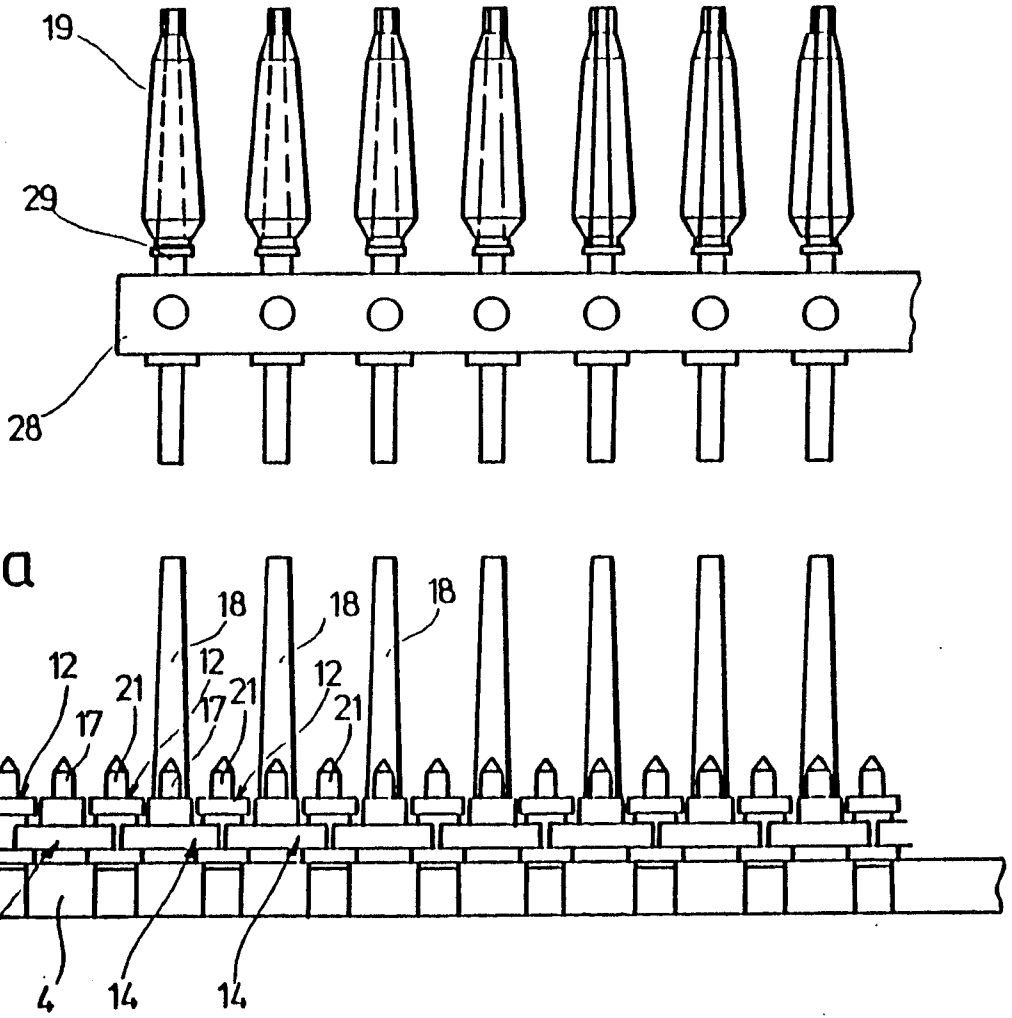
FIGS. 5*a–h* are elevational views of a portion of the textile machine and the transport apparatus shown in FIG. 1 during progressive operational steps of a tube transfer operation.

The operation of the transport assembly to deliver empty tubes to the spinning stations of the spinning machine 1 and to transport tubes having full yarn packages built thereon from the spinning stations will now be described with reference to FIGS. 5*a–h*. As seen in FIG. 5*a*, the spinning machine 1 includes a spindle bank 28 (only one of which is shown) along each longitudinal side. Each spindle bank 28 includes a number of uniformly spaced spindles 29 for supporting tubes during the building of yarn thereon to build a plurality of full yarn packages 19. When the spinning stations along one longitudinal side of the spinning machine 1 have completed the building of the full yarn packages 19 supported along a portion, or the entire extent, of one of the spindle banks 28, a conventional control unit (not shown) controls the transport assembly of the present invention to effect delivery of a supply of empty tubes 18 to the respective spinning stations.

As seen in the lower portion of FIG. 5*a*, peg trays 14 are retained between each adjacent pair of the carrier members 12 for transport to the respective spinning stations by the endless travel of the belt 4. Each peg tray 14 has an empty tube 18 inserted onto its post 17 and supported by its collar 15 in an upright disposition. The empty tubes 18 may have been loaded onto the peg trays 14 in, for example, a manual loading operation or by a conventional tube loading device.

The spacing between the posts 17 of each adjacent pair of the retained peg trays 14 generally corresponds to the uniform spacing between each adjacent pair of the spindles 29 on the spindle bank 28. Additionally, the spacing between each adjacent pair of the posts 21 of the tube support members fixed to the belt 4 and incorporated in the carrier members 12 also generally corresponds to the uniform spacing between each adjacent pair of the spindles 29 on the spindle bank 28. The spacing between each post 21 of a fixed tube support member and the post 17 of the peg tray 14 retained by the respective carrier member 12 generally corresponds to one-half the uniform spacing between each adjacent pair of the spindles 29 on the spindle bank 28.

The endless operation of the belt 4 is controlled to bring each of the empty tubes 18 supported in upright dispositions on the peg trays 14 into individual vertical alignment with a respective spindle 29 of the spindle bank 28. Then, as seen in FIG. 5*b*, the empty tubes 18 are gripped by a conventional tube gripping assembly 30 and are simultaneously upwardly moved thereby beyond the upper free ends of the posts 17 of the peg trays 14.

Figure 5B:
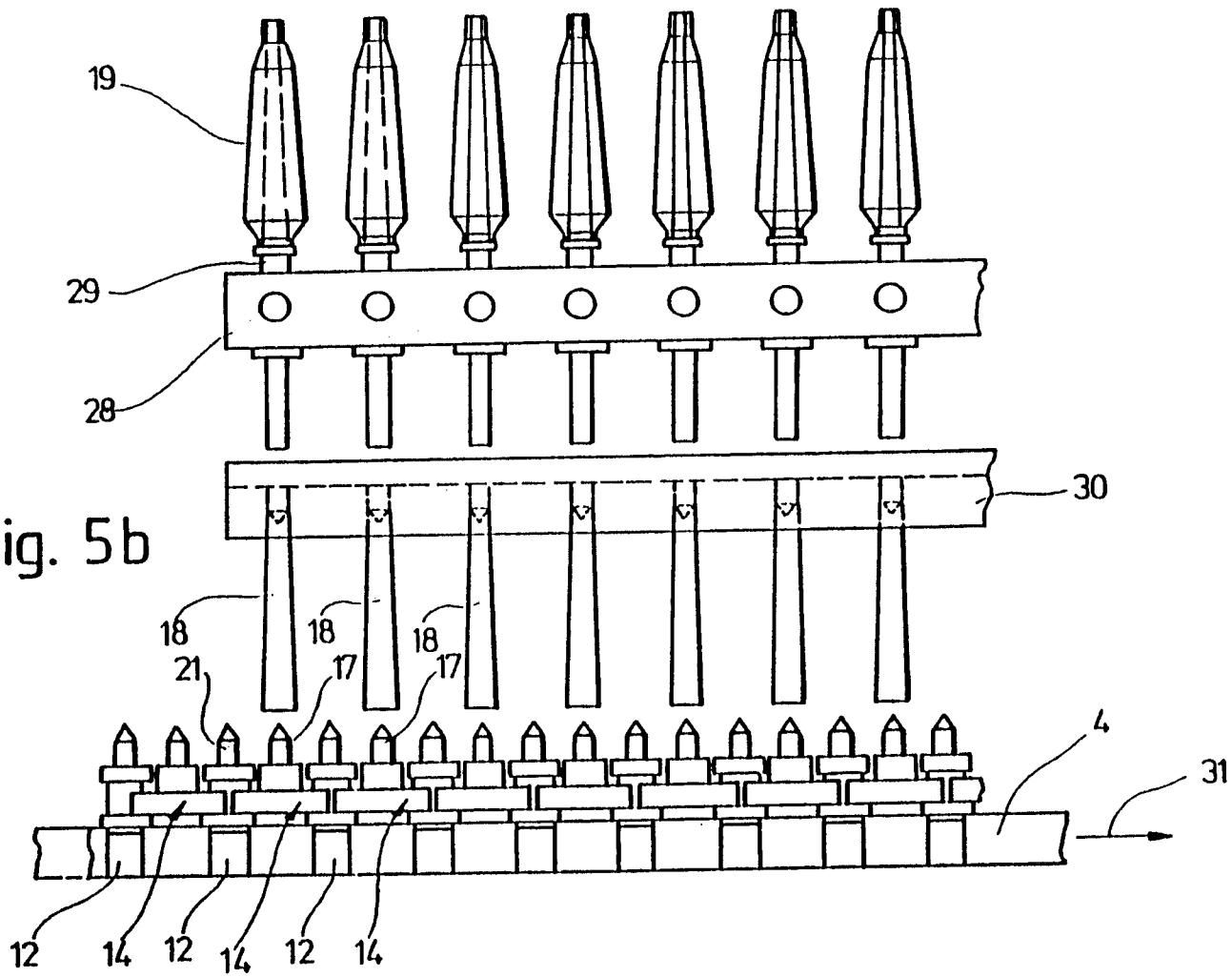
Figure 5C:
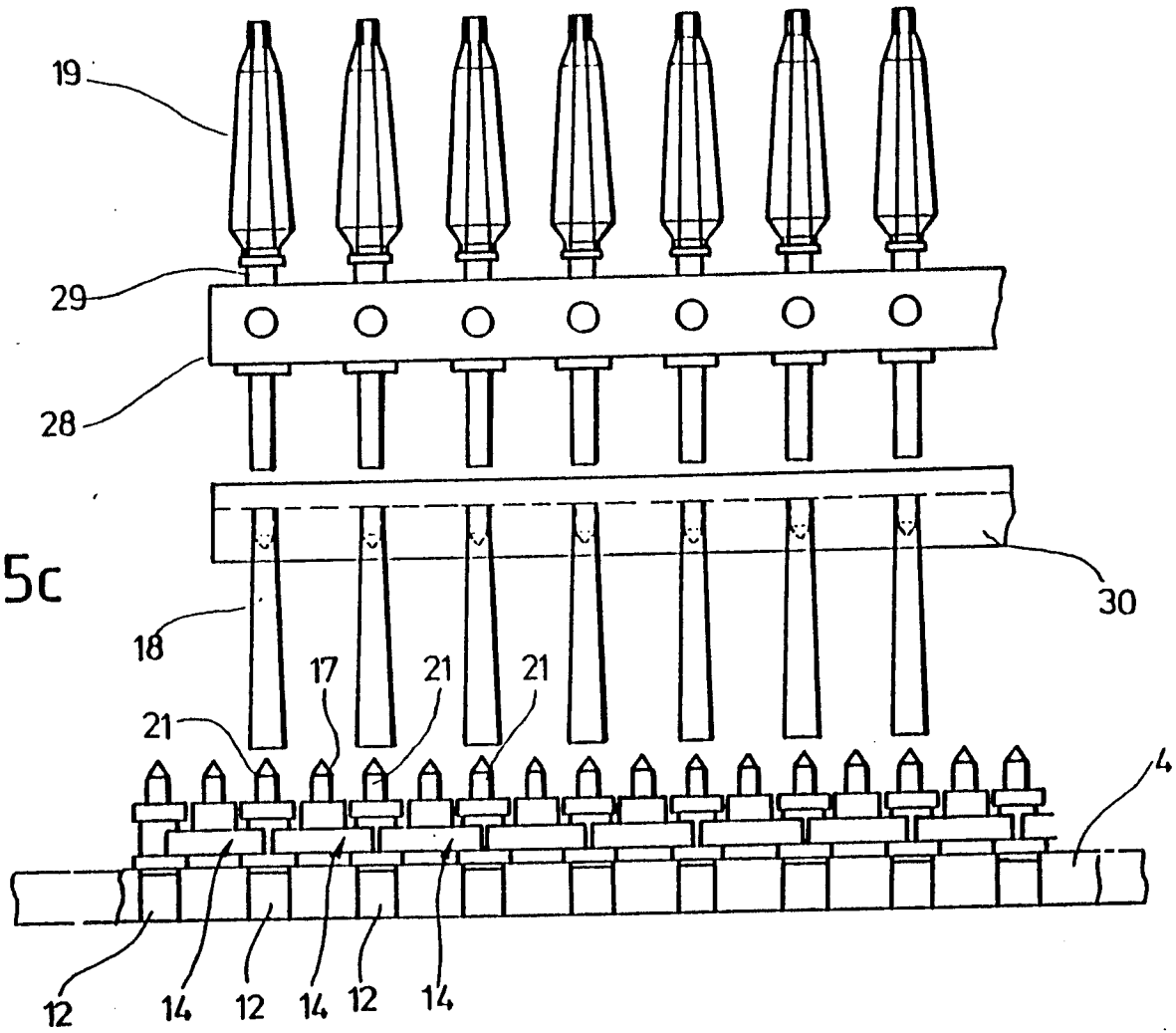
Figure 5D:
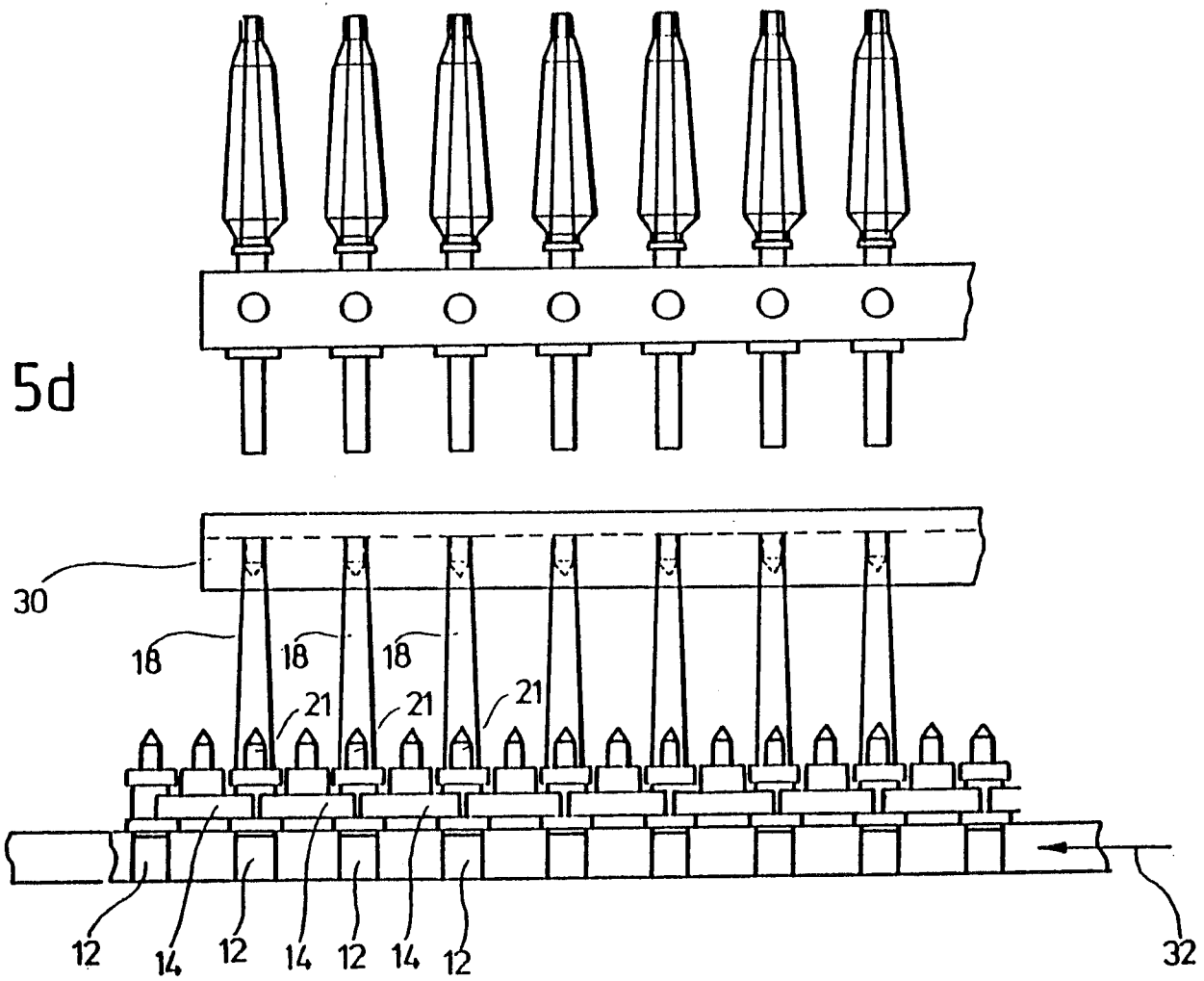

As seen in FIGS. 5*c*, the tube gripping assembly 30 is controlled to retain the gripped empty tubes 18 in their raised disposition while the belt 4 is controlled to transport the retained peg trays 14 through a predetermined distance in the travel direction indicated by the arrow 31 in FIG. 5*b* such that each respective post 21 of a carrier member 12 is brought into vertical alignment with a respective one of the raised empty tubes As seen in FIG. 5*d*, the next operational step involves controlling the tube gripping assembly 30 to simultaneously insert the gripped empty tubes 18 over the respective posts 21 vertically aligned therewith. Thereafter, the tube gripping member 30 is controlled to release the empty tubes 18 so that each empty tube 18 is now supported on a carrier member 12.

Figure 5E:
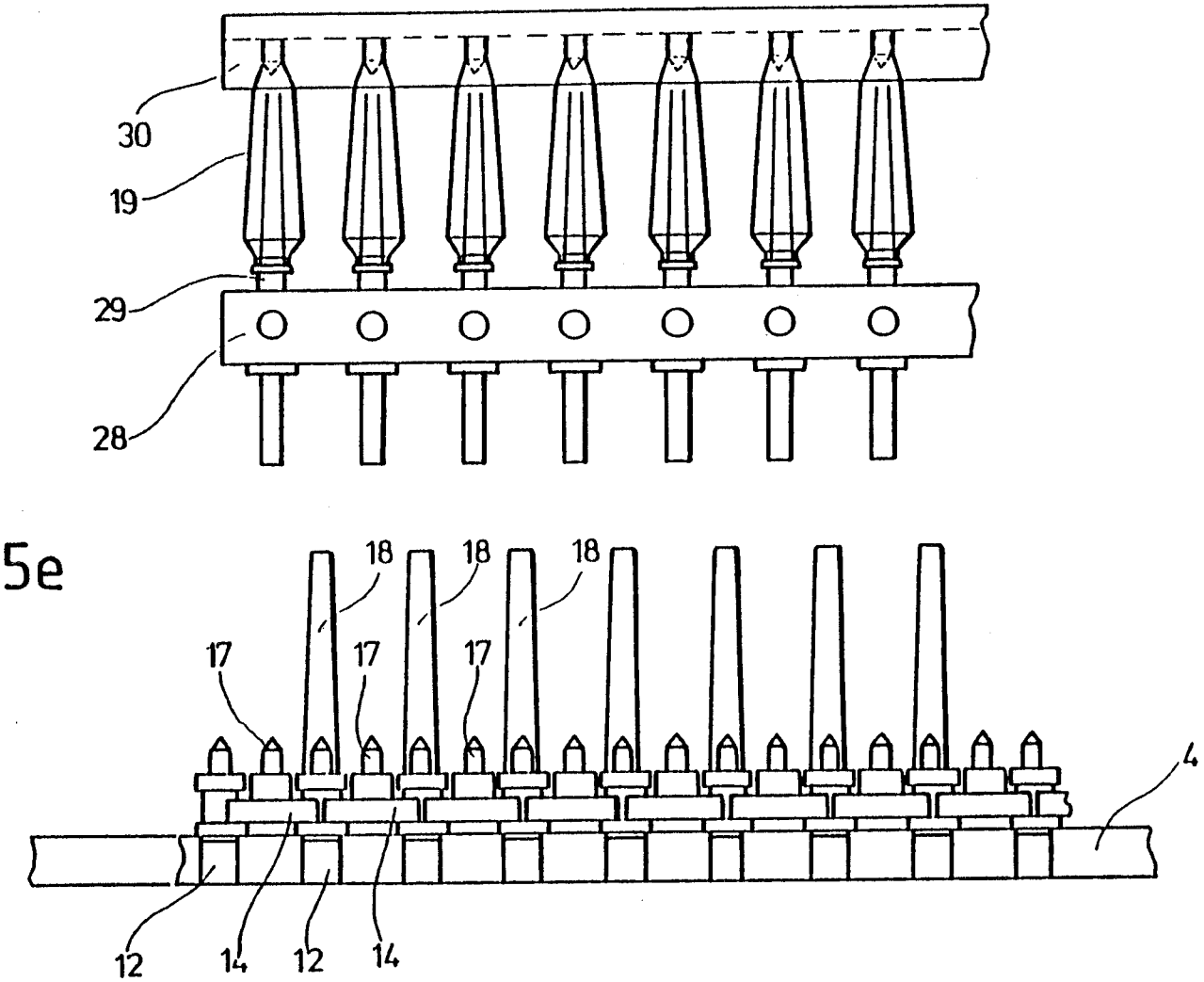

As seen in FIG. 5*e*, the tube gripping member 30 is then controlled to bring it into position for gripping the full yarn packages 19 which are supported on the spindles 29 of the spindle bank 28. The tube gripping member 30 is then operated to grip the tubes 19. In coordination with the gripping of the tubes 19 by the tube gripping member 30, the control unit controls the belt 4 to transport the retained peg trays 14 through a predetermined return distance in the travel direction indicated by the arrow 32 in FIG. 5*f* such that the posts 17 of the retained peg trays 14 are returned to their respective positions in which they were initially vertically aligned with the spindles 29 (i.e.—the positions shown in FIG. 5*a*). Accordingly, the predetermined return distance corresponds to the amount of travel of the belt 4 sufficient to move each posts 17 of the peg trays 14 by an amount equal to one-half the uniform spacing between the spindles 29.

Figure 5F:
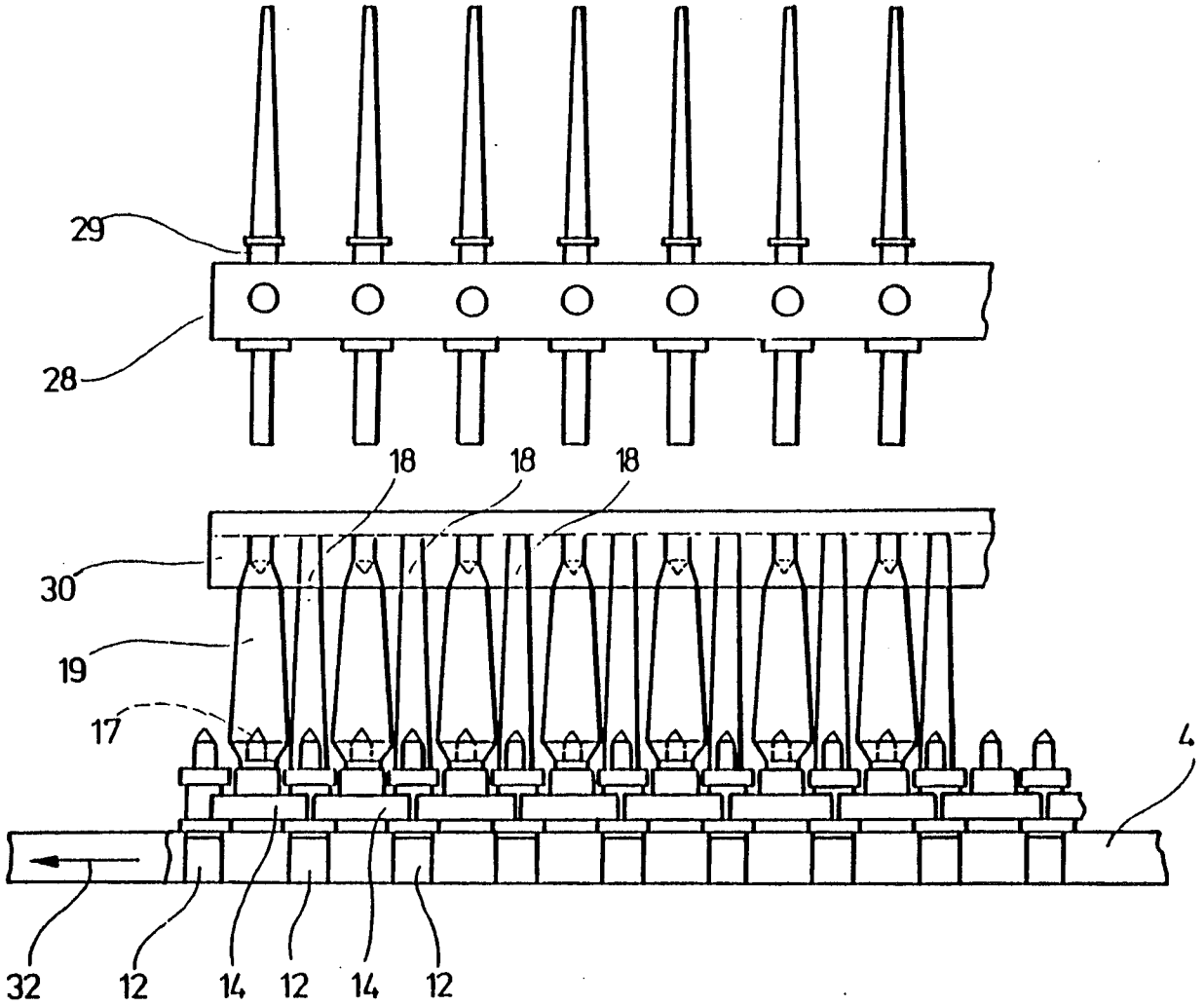

As seen in FIG. 5*f*, the tube gripping member 30 is then operated to initially raise the full yarn packages 19 from their respective spindles 29 and, thereafter, to lower the gripped full yarn packages 19 onto the respective vertically aligned posts 17 of the peg trays 14. The tube gripping member 30 is then operated to release the full yarn packages 19 onto the posts 17 to be fully supported by the peg trays 14. Each peg tray 14 now supports a full yarn package and each carrier member 12 supports an empty tube 18.

Figure 5G:
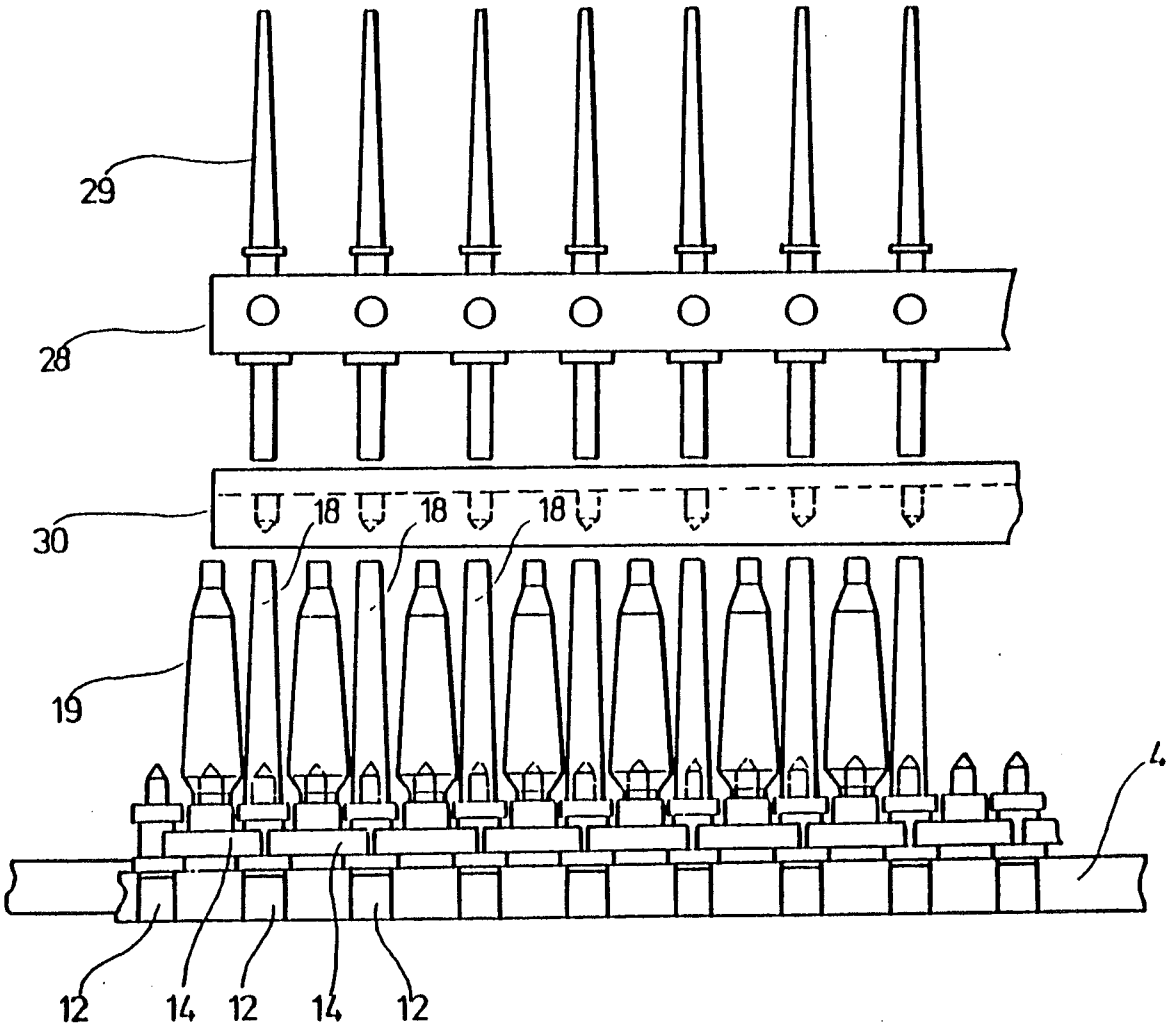

As seen in FIG. 5*g*, the next operational step involves controlling the belt 4 to transport the retained peg trays 14 through a predetermined transfer distance in the travel direction 32 shown in FIG. 5*f* such that the empty tubes 18 are brought into their respective initial individual vertical alignments with the spindles 29 of the spindle bank 28 (i.e.—the positions shown in FIGS. 5*c* and *d*). Accordingly, the predetermined transfer distance corresponds to the amount of travel of the belt 4 sufficient to shift each empty tube by an amount corresponding to one-half the uniform spacing between the spindles 29.

Figure 5H:
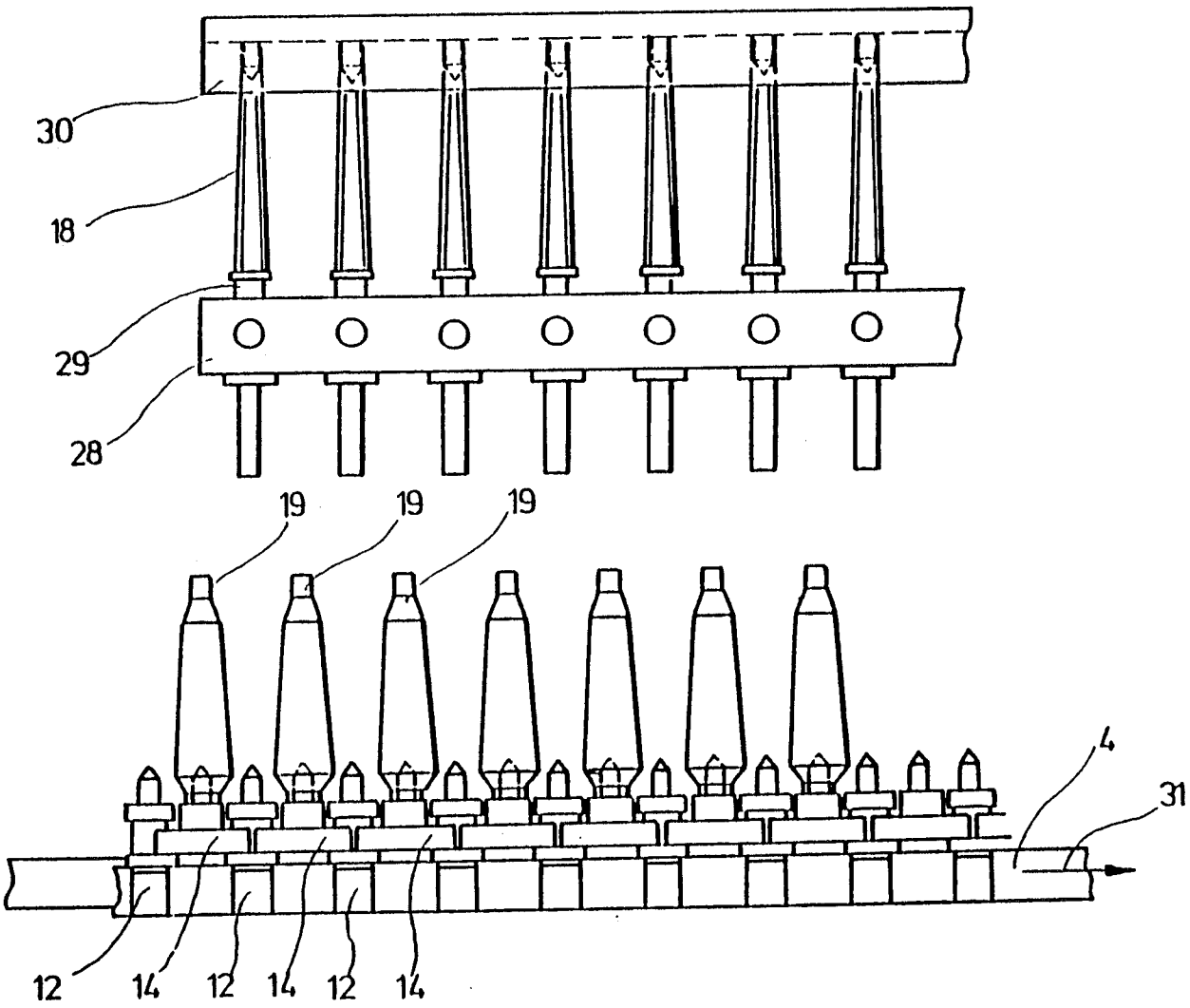

As seen in FIG. 5*h*, once the empty tubes 18 have been vertically aligned with the spindles 29 in the operational step shown in FIG. 5*g*, the tube gripping member 30 is operated to grip the empty tubes 18, raise the empty tubes from the carrier members 12 and transfer the empty tubes 18 onto the spindles 29 of the spindle bank 28. In correspondence with the empty tube transfer movements of the tube gripping member 30, the belt 4 is operated to travel in the travel direction indicated by the arrow 31 in FIG. 5*h* to transport the tubes 19 having full yarn packages built thereon to a further handling location such as, for example, a location for transferring the tubes 19 to an associated textile winding machine.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In a textile spinning machine of the type in which yarn is handled on tubes, the spinning machine having a plurality of spindles supported on a spindle bank at a uniform spindle spacing from one another, a transport apparatus for transporting tubes, comprising:

a plurality of independent tube support members, each having a vertical post for receiving a tube inserted thereon for individual support of the tube in an upright disposition, a flexible endless member arranged for travel in a path along the spindle bank;

drive means for driving said flexible endless member in its travel path;

retaining means, mounted to said flexible endless member, for releasably retaining said independent tube support members for transport by said flexible endless member, said retaining means supporting the independent tube support members with the vertical posts of said tube support members spaced apart at a spacing substantially equal to the uniform spacing between the spindles of the spinning machine; and a plurality of spaced fixed tube support members secured to said flexible endless member, each fixed tube support element having a vertical post for receiving a tube inserted thereon for transport of the tube by said flexible endless member, said fixed tube support members being spaced apart with the vertical posts of said fixed tube support members spaced apart at a spacing substantially equal to the uniform spacing between the spindles of the spinning machine.

2. In a textile spinning machine, the transport apparatus according to claim 1 and characterized further in that each independent tube support member includes a tube end support collar from which the vertical post of the tube support member projects, the tube end support collar having a surface for supporting the end of a tube inserted on the vertical post, each fixed tube support member includes a tube end support portion from which the vertical post of the fixed tube support member extends, the tube end support portion having a surface for supporting the end of a tube inserted on the vertical post and said retaining means supports the independent tube support members at a height at which the surfaces of the tube end support collars of the independent tube support members are generally at the same height as the surfaces of the tube end support portions of said fixed tube support members.

3. In a textile spinning machine, the transport apparatus according to claim 1 and characterized further in that each independent tube support member includes an annularly shaped base and an annularly shaped supporting collar mounted on said base, said supporting collar being of a lesser diameter than said base, and said retaining means includes a plurality of carrier members mounted on said flexible endless member at uniform spacings therealong, each adjacent pair of said carrier members having a space therebetween less than the diameter of the base of a tube support member and greater than the diameter of the supporting collar of the tube support member and adjacent carrier members cooperating together to releasably retain an independent tube support member therebetween for transport by said flexible endless member with the supporting collar of the independent tube support member being disposed between the adjacent carrier members.

4. In a textile spinning machine, the transport apparatus according to claim 1 and characterized further in that said retaining means includes a plurality of carrier members mounted on said flexible endless member at uniform spacings therealong, and each said carrier member is formed with an opening for retaining receipt of a portion of an independent tube support member for releasably retaining tube support members in the openings of said carrier members.

5. In a textile spinning machine, the transport apparatus according to claim 4 and characterized further in that each carrier member includes a lower portion extending transversely with respect to said flexible endless member and having an upper surface at a vertical spacing above said flexible endless member, an upper portion having a lower surface positioned at a vertical spacing above said upper surface of said lower portion, and an intermediate portion, said upper surface of said lower portion and said lower surface of said upper portion forming said opening therebetween for receiving the bases of independent tube support members therebetween, said intermediate portion being positioned for limiting the lateral movement of supported independent tube support members with said upper portion and intermediate portion retaining independent tube support members on said lower portion.

6. In a textile spinning machine, the transport apparatus according to claim 5 and characterized further in that each upper portion includes an upper surface and the vertical post of each fixed tube support member extends from the upper surface of a respective upper portion, and the upper surface of each upper portion supports a tube end of a tube inserted onto the respective vertical post extending therefrom.

7. In a textile spinning machine, the transport apparatus according to claim 5 and characterized further in that said lower portion, said intermediate portion and said upper portion are integrally formed in a C-shaped configuration.

8. In a textile spinning machine, the transport apparatus according to claim 7 and characterized further in that said C-shaped configuration includes a foot portion extending from said lower portion and secured to said flexible endless member.

9. In a textile spinning machine, the transport apparatus according to claim and characterized further in that said retaining means includes a plurality of carrier members mounted on said flexible endless member at uniform spacings therealong, said carrier members being operable to retain said independent tube support members in alternating relation with said fixed tube support members along the extent of said flexible endless member.

10. In a textile spinning machine, the transport apparatus according to claim 9 and characterized further in that said carrier members retain said independent tube support members with the vertical posts of said independent tube support members spaced from the vertical posts of the fixed tube support members at a spacing substantially equal to one half the spindle spacing.

11. In a textile spinning machine of the type in which yarn is handled on tubes, the spinning machine having a plurality of spindles supported on a spindle bank at a uniform spindle spacing from one another, a transport apparatus for transporting tubes comprising:

a plurality of independent tube support members, each having a vertical posts for receiving a tube inserted thereon for individual support of the tube in an upright disposition, a flexible endless member arranged for travel in a closed path along the spindle bank, said flexible endless member having a thickness extent and a width extent, said thickness extent being substantially less than said width extent to impart a generally flat shape to said flexible endless member;

means for supporting said flexible endless member with said width extent thereof in a generally vertical orientation during travel of said flexible endless member with said flexible endless member flexing in the horizontal direction as it travels;

drive means for driving said flexible endless member in said closed travel path;

retaining means, mounted to said flexible endless member, for releasably retaining said independent tube support members for transport by said flexible endless member, said retaining means supporting said independent tube support members with the vertical posts thereof spaced apart at a spacing substantially equal to the uniform spacing between the spindles of the spinning machine; and a plurality of spaced fixed tube support members secured to said flexible endless member, each fixed tube support having a vertical post for receiving a tube inserted thereon for transport of the tube by said flexible endless member.

12. In a textile spinning machine, the transport apparatus according to claim 11 and characterized further in that said fixed tube support members are spaced from one another such that the vertical posts thereof are at a spacing substantially equal to the uniform spacing between the spindles of the spinning machine.

13. In a textile spinning machine, the transport apparatus according to claim 11 and characterized further in that said fixed tube support members are spaced apart from one another such that the vertical posts thereof are at a spacing substantially equal to the uniform spacing between the spindles of the spinning machine.

14. In a textile spinning machine, the transport apparatus according to claim 13 and characterized further in that said retaining means includes means for supporting each respective independent tube support member between an adjacent pair of said spaced fixed tube support members such that the vertical posts of said independent tube support members and said vertical posts of said fixed tube support members are at a spacing from one another substantially equal to one-half the spacing between the spindles of the spinning machine.

15. In a textile spinning machine, the transport apparatus according to claim 11 and characterized further in that each independent tube support member includes a tube end support collar from which the vertical post of the independent tube support member projects, the tube end support collar having a surface for supporting the end of a tube inserted on the vertical post, each fixed tube support member includes a tube end support portion from which the vertical post of the fixed tube support member extends, the tube end support portion having a surface for supporting the end of a tube inserted on the vertical post and said retaining means includes means for supporting the independent tube support members at a height at which the surfaces of the tube end support collars of the independent tube support members are generally at the same height as the surfaces of the tube end support portions of said fixed tube support members.

16. In a textile spinning machine, the transport apparatus according to claim 11 and characterized further in that said means for supporting said flexible endless member for travel in said closed path includes a pair of vertical wall members oriented in spaced, superposed facing relation with one another for slidably receiving said flexible endless member therebetween.

17. In a textile spinning machine, the spinning machine according to claim 16 and characterized further in that said means for supporting said flexible endless member includes a horizontal surface portion mounted on a selected one of said vertical wall members and said retaining means includes a horizontal sliding portion for sliding travel along said horizontal surface portion.

18. In a textile spinning machine, the spinning machine according to claim 16 and characterized further in that said retaining means includes a plurality of carrier members mounted on said flexible endless member, each carrier member having a first vertical surface for sliding travel along one of said vertical wall members and a second vertical surface for sliding travel along the other of said vertical wall members with said flexible endless member being disposed intermediate said first and second vertical surfaces of each said carrier member, said carrier members supporting said flexible endless member in a generally vertical orientation during travel of said flexible endless member in said closed path and each adjacent pair of said carrier members supporting a respective one of said independent tube support members therebetween for transport of said independent tube support members by said flexible endless member.

* * * * *